US005573692A

United States Patent [19]

Das et al.

[11] Patent Number: 5,573,692

[45] Date of Patent: Nov. 12, 1996

[54] PLATINUM HEATER FOR ELECTRICAL SMOKING ARTICLE HAVING OHMIC CONTACT

[75] Inventors: Amitabh Das; Peter J. Lipowicz, both of Midlothian; W. Randolph Sweeney, Richmond, all of Va.

[73] Assignee: Philip Morris Incorporated, New York, N.Y.

[21] Appl. No.: 314,463

[22] Filed: Sep. 28, 1994

Related U.S. Application Data

[63] Continuation-in-part of Ser. No. 105,346, Aug. 10, 1993, Pat. No. 5,479,548, and a continuation-in-part of Ser. No. 118,665, Sep. 10, 1993, Pat. No. 5,388,594, which is a continuation-in-part of Ser. No. 943,504, Sep. 11, 1992, Pat. No. 5,505,214, which is a continuation-in-part of Ser. No. 666,926, Mar. 11, 1991, abandoned.

[51] Int. Cl.[6] ..... H05B 3/16

[52] U.S. Cl. ..... 219/543; 219/553; 338/309; 128/202.21; 131/273

[58] Field of Search ..... 219/541, 543, 219/552–553; 338/306–309; 131/194, 273; 128/202.21

[56] References Cited

U.S. PATENT DOCUMENTS

| | | |
|---|---|---|
| 1,771,366 | 7/1930 | Wyss et al. . |
| 1,968,509 | 7/1932 | Tiffany . |
| 2,057,353 | 10/1936 | Whittemore . |
| 2,104,266 | 1/1938 | McCormick . |
| 2,442,004 | 5/1948 | Hayward-Butt . |
| 2,974,669 | 3/1961 | Ellis . |
| 3,200,819 | 8/1965 | Gilbert . |
| 3,255,760 | 6/1966 | Selke . |
| 3,363,633 | 1/1968 | Weber . |

(List continued on next page.)

FOREIGN PATENT DOCUMENTS

| | | |
|---|---|---|
| 1202378 | 3/1986 | Canada . |
| 87/104459 | 2/1988 | China . |
| 87/104459 | 2/1988 | China . |
| 0 438 862 | 7/1982 | European Pat. Off. . |
| 0 295 122 | 12/1988 | European Pat. Off. . |
| 0 358 114 | 3/1990 | European Pat. Off. . |
| 0 358 002 | 3/1990 | European Pat. Off. . |
| 0 430 566 | 6/1991 | European Pat. Off. . |
| 36 40 917 A1 | 8/1988 | Germany . |
| 36 40 917 | 8/1988 | Germany . |
| 37 35 704 | 5/1989 | Germany . |
| 37 35 704 A1 | 5/1989 | Germany . |
| 61-68061 | 4/1986 | Japan . |
| 63-165068 | 7/1988 | Japan ..... B23K 1/14 |
| 2 059 323 | 4/1981 | United Kingdom ..... C04B 37/02 |
| 2 132 539 | 7/1984 | United Kingdom . |
| 2 148 079 | 5/1985 | United Kingdom . |
| 2 148 676 | 5/1985 | United Kingdom . |
| WO86/02528 | 4/1986 | WIPO . |
| 86/02528 | 5/1986 | WIPO . |

OTHER PUBLICATIONS

Excerpt from "NASA Tech Briefs," Jul./Aug. 1988, p. 31.

"PCT Thermistors," Keystone Carbon Company product literature.

U.S. Patent Application Ser. No. 07/443,636, filed Nov. 29, 1989.

*Primary Examiner*—Teresa J. Walberg
*Assistant Examiner*—Raphael Valencia
*Attorney, Agent, or Firm*—James T. Moore; James E. Schardt; Charles E. B. Glenn

[57] ABSTRACT

A thin film layer of primarily platinum is deposited onto a ceramic substrate and electrical connections are applied to the platinum layer to form a heater. In a preferred embodiment, the electrical connections comprise two electrically conductive posts fixed to the ceramic substrate at a first end and electrically contacting the platinum heater layer near this first end. Preferably, the heater layer forms mounds at each post and a thinner region therebetween, resulting in a resistance profile which concentrates heating in the thinner region and reduces undesired heating of the post area. Such heaters can be employed individually or in conjunction with other similar heaters.

29 Claims, 5 Drawing Sheets

U.S. PATENT DOCUMENTS

| | | | |
|---|---|---|---|
| 3,402,723 | 9/1968 | Hu . | |
| 3,482,580 | 12/1969 | Hollabaugh . | |
| 3,608,560 | 9/1971 | Briskin et al. . | |
| 3,738,374 | 6/1973 | Bennett . | |
| 3,744,496 | 7/1973 | McCarty et al. . | |
| 3,804,100 | 4/1974 | Fariello . | |
| 3,889,690 | 6/1975 | Guarnieri . | |
| 3,911,533 | 10/1975 | Burgess | 228/173 |
| 4,016,061 | 4/1977 | Wasa et al. . | |
| 4,068,672 | 1/1978 | Guerra . | |
| 4,077,784 | 3/1978 | Vayrynen . | |
| 4,129,243 | 12/1978 | Cusano | 228/122 |
| 4,129,848 | 12/1978 | Frank et al. | 338/308 |
| 4,131,119 | 12/1978 | Blasutti . | |
| 4,141,369 | 2/1979 | Burruss . | |
| 4,146,957 | 4/1979 | Toenshoff | 29/612 |
| 4,164,230 | 8/1979 | Pearlman . | |
| 4,193,411 | 3/1980 | Faris et al. . | |
| 4,215,708 | 8/1980 | Bron . | |
| 4,219,032 | 8/1980 | Tabatnik et al. . | |
| 4,246,913 | 1/1981 | Ogden et al. . | |
| 4,256,945 | 3/1981 | Carter et al. . | |
| 4,259,970 | 4/1981 | Green Jr. . | |
| 4,303,083 | 12/1981 | Burruss, Jr. . | |
| 4,319,591 | 3/1982 | Keith et al. . | |
| 4,393,884 | 7/1983 | Jacobs . | |
| 4,409,278 | 10/1983 | Jochym | 428/163 |
| 4,431,903 | 2/1984 | Riccio . | |
| 4,436,100 | 3/1984 | Green, Jr. . | |
| 4,463,247 | 7/1984 | Lawrence et al. . | |
| 4,505,282 | 3/1985 | Cogbill et al. . | |
| 4,562,337 | 12/1985 | Lawrence . | |
| 4,570,646 | 2/1986 | Herron . | |
| 4,580,583 | 4/1986 | Green, Jr. . | |
| 4,621,649 | 11/1986 | Osterrath . | |
| 4,623,401 | 11/1986 | Derbyshire et al. . | |
| 4,627,902 | 12/1986 | Johnston et al. | 338/308 |
| 4,637,407 | 1/1987 | Bonanno et al. . | |
| 4,659,912 | 4/1987 | Derbyshire . | |
| 4,688,015 | 8/1987 | Kojima et al. | 338/34 |
| 4,735,217 | 4/1988 | Gerth et al. . | |
| 4,771,796 | 9/1988 | Myer . | |
| 4,776,353 | 10/1988 | Lija et al. . | |
| 4,785,150 | 11/1988 | Kojima et al. | 219/543 |
| 4,805,296 | 2/1989 | Jinda et al. | 338/308 |
| 4,837,421 | 6/1989 | Luthy . | |
| 4,846,199 | 7/1989 | Rose . | |
| 4,848,376 | 7/1989 | Lija et al. . | |
| 4,849,292 | 7/1989 | Mizunoya | 428/433 |
| 4,860,939 | 8/1989 | Guinet | 228/122 |
| 4,874,924 | 10/1989 | Yamamoto et al. . | |
| 4,877,989 | 10/1989 | Drews . | |
| 4,901,051 | 2/1990 | Murata et al. | 338/308 |
| 4,922,901 | 5/1990 | Brooks et al. . | |
| 4,945,931 | 8/1990 | Gori . | |
| 4,947,874 | 8/1990 | Brooks et al . | |
| 4,947,875 | 8/1990 | Brooks et al. . | |
| 4,952,903 | 8/1990 | Shibata et al. | 219/553 |
| 4,966,171 | 12/1990 | Serrano et al. . | |
| 4,981,522 | 1/1991 | Nichols et al. . | |
| 4,991,606 | 2/1991 | Serrano et al. . | |
| 5,040,552 | 8/1991 | Nystrom et al. . | |
| 5,060,671 | 10/1991 | Counts et al. . | |
| 5,076,296 | 12/1991 | Schleich et al. . | |
| 5,093,894 | 3/1992 | Deevi et al. . | |
| 5,108,026 | 4/1992 | Su | 228/122 |
| 5,159,940 | 11/1992 | Hayward et al. . | |
| 5,224,498 | 7/1993 | Deevi et al. | 131/194 |
| 5,408,574 | 4/1995 | Deevi et al. | 128/202.21 |

RESISTANCE PROFILE ALONG HEATER

TEMPERATURE PROFILE ALONG HEATER

PLATINUM HEATER FOR ELECTRICAL SMOKING ARTICLE HAVING OHMIC CONTACT

CROSS REFERENCE TO RELATED APPLICATIONS

The present application is a continuation-in-part of commonly assigned patent applications Ser. No. 08/105,346, filed Aug. 10, 1993, now U.S. Pat. NO. 5,479,548, and Ser. No. 08/118,665, filed Sep. 10, 1993, U.S. Pat. No. 5,388,594 the latter in turn being a continuation-in-part of commonly assigned patent application 07/943,504, filed Sep. 11, 1992, U.S. Pat. No. 5,505,214, which in turn is a continuation-in-part of U.S. patent application Ser. No. 07/666,926 filed Mar. 11, 1991, now abandoned in favor of filewrapper continuation application Ser. No. 08/012,799, filed Feb. 2, 1993, which are hereby incorporated by reference.

BACKGROUND OF THE INVENTION

1. Technical Field of the Invention

The present invention relates generally to heaters for use, e. g., in an electrical smoking article and more particularly to a platinum coated heater for use, e.g., in an electrical smoking article.

2. Discussion of the Related Art

Isolated heaters capable of repeatedly converting amounts of energy commonly found in batteries to relatively high temperatures of, e.g., between approximately 700°–1100° C. in approximately one second, are desirable in many situations. For example, high temperature sensors and heat sources are finding numerous applications. Current heaters can comprise a resistive metal heater layer applied to a ceramic substrate. The laminate heater structures often disbond during repeated extreme thermal pulsings of high temperatures and short duration, thereby limiting their applicability in many situations.

For example, previously known conventional smoking devices deliver flavor and aroma to the user as a result of combustion. A mass of combustible material, primarily tobacco, is oxidized as the result of applied heat with typical combustion temperatures in a conventional cigarette being in excess of 800° C. during puffing. Heat is drawn through an adjacent mass of tobacco by drawing or the mouth end. During this heating, inefficient oxidation of the combustible material takes place and yields various distillation and pyrolysis products. As these products are drawn through the body of the smoking device toward the mouth of the user, they cool and condense to form an aerosol or vapor which gives the consumer the flavor and aroma associated with smoking.

Conventional cigarettes have various perceived drawbacks associated with them. Among them is the production of sidestream smoke during smoldering between puffs, which may be objectionable to some non-smokers. Also, once lit, they must be fully consumed or be discarded. Relighting a conventional cigarette is possible but is usually an unattractive prospect for subjective reasons (flavor, taste, odor) to a discerning smoker.

A prior alternative to the more conventional cigarettes are those in which the combustible material itself does not directly provide the flavorants to the aerosol inhaled by the smoker. In these smoking articles, a combustible heating element, typically carbonaceous in nature, is combusted to heat air as it is drawn over the heating element and through a zone which contains heat-activated elements that release a flavored aerosol. While this type of smoking device produces little or no sidestream smoke, it still generates products of combustion, and once lit it is not adapted to be snuffed for future use in the conventional sense.

In both the more conventional and carbon element heated smoking devices described above combustion takes place during their use. This process naturally gives rise to many by-products as the combusted material breaks down and interacts with the surrounding atmosphere.

Commonly assigned U.S. Pat. Nos. 5,093,894; 5,225,498; 5,060,671 and 5,095,921 disclose various heating elements and flavor generating articles which significantly reduce sidestream smoke while permitting the smoker to selectively suspend and reinitiate smoking. However, the cigarette articles disclosed in these patents are not very durable and may degrade, collapse, tear or break from extended or heavy handling. In certain circumstances, these prior cigarette articles may be damaged or damage the cartridge as they are inserted into the electric lighters. Once they are smoked, they are even weaker and may tear or break as they are removed from the lighter.

U.S. patent application Ser. No. 08/118,665, filed Sep. 10, 1993, describes an electrical smoking system including an electrically powered lighter and novel cigarette that is adapted to cooperate with the lighter. The preferred embodiment of the lighter includes a plurality of metallic sinusoidal or serpentine heaters disposed in a configuration that slidingly receives a tobacco rod portion of the cigarette.

These proposed heaters are relatively fragile and are subject to mechanical weakening and possible failure due to stresses induced by inserting and removing the cylindrical tobacco medium and also by adjusting or toying with the inserted cigarette. More significantly, thermal cycling induces thermal stresses and fatigue in the heaters which may result in heater failure. Also, undesirable oxidation of heater material can result from repeated firings.

An electrical smoking article preferably should last between a few months, e.g., six months, to a year or more of normal use defined as equivalent to smoking a pack of more conventional cigarettes per day. Assuming eight puffs per a more conventional cigarette and twenty more conventional cigarettes per pack, the number of thermal pulsings by the heater is significant.

In addition, a heater for a smoking article having a movable tobacco flavor medium such as described in the above-mentioned commonly assigned patent application Ser. No. 08/105,346 requires relatively precise registry, especially if a direct contact between the heater and the tobacco flavor medium is necessary to transfer an adequate amount of heat to the tobacco flavor medium to evolve flavors.

In any heater, e.g., for use in an electrical smoking article, it is desirable to reduce power requirements for a heater to lengthen the useful life between chargings or replacement of the power source.

OBJECTS OF THE INVENTION

It is accordingly an object of the present invention to provide a heater capable of being repeatedly pulsed to consistently convert electrical energy into a high heat pulse of short duration.

It is another object of the present invention to provide a heater for an electrical smoking article which can be repeatedly pulsed a determined number of times, e.g., for a pack-year.

It is another object of the present invention to provide a heater which does not suffer oxidation degradation after a determined number of repeated pulsings.

It is yet another object of the present invention to provide a heater which does not experience significant changes in electrical characteristics after a determined number of repeated pulsings.

It is a further object of the present invention to provide a heater for an electrical smoking article which generates sufficient heat to evolve flavors from a tobacco flavor medium.

It is another object to reduce power requirements of a heater which generates sufficient heat to evolve flavors from a tobacco flavor medium.

It is further object of the present invention to provide a heater having sufficient mechanical strength, stiffness and smoothness to accomplish repeated insertions, heatings and removals of inserted tobacco flavor medium.

It is another object of the present invention to provide a heater having sufficient mechanical integrity for repeated pulsings.

Additional objects and advantages of the present invention are apparent from the specification and drawings which follow.

SUMMARY OF THE INVENTION

The foregoing and additional objects are obtained by a heater according to the present invention for use, e.g., in an electrical smoking article to heat a tobacco flavor medium. A thin film layer of primarily platinum is deposited onto a lapped ceramic substrate and electrical connections are applied to the platinum layer to form a heater. In a preferred embodiment, the electrical connections comprise two electrically conductive posts fixed to the ceramic substrate at a first end and electrically contacting the platinum heater layer near this first end. Preferably, the heater layer is subsequently formed of mounds at each post and a thinner region therebetween, resulting in a resistance profile which concentrates heating in the thinner region and reduces undesired heating of the post areas. Such heaters can be employed individually or in conjunction with other similar heaters.

DETAILED DESCRIPTION OF THE PREFERRED EMBODIMENT

The present invention provides a heater for use, e.g., in an electrical smoking article which generates heat via electrical resistance to evolve flavors from a tobacco flavor medium. A thin platinum layer, e.g., approximately 1 to 2 μm thick, is deposited onto a lapped ceramic substrate having a roughly matching coefficient of thermal expansion to minimize thermally induced delamination. The ceramic has a determined roughness to affect the electrical resistance and achieve adhesion of the deposited platinum layer. The platinum layer does not experience oxidation degradation or other corrosion during projected life cycles. The formed heater can be employed in any application wherein a repeated heat pulse of the described amount and duration is required, e.g., in other heat source and sensor applications. The heater according to the present invention can be employed in the smoking articles described in Ser. No. 08/105,346. This application describes a cassette-type delivery system wherein a tape comprising tobacco flavor medium is registered with a heater. Preferably, the heater according to the present invention is arranged such that the side of ceramic substrate opposite applied platinum layer is facing the tobacco flavor medium.

Figure 1:
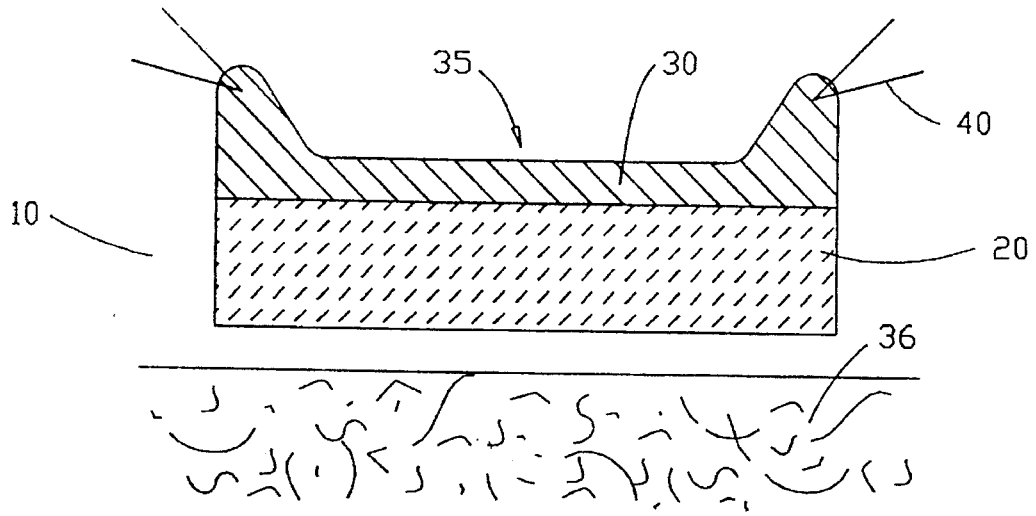
FIG. 1 is an exposed side view of a first embodiment of the heater according to the present invention.

A first embodiment of a heater 10 according to the present invention is shown in FIG. 1. A substrate 20 is provided and comprises a ceramic such as alumina, titania, zirconia or yttria-stabilized zirconia which does not experience oxidation at the operating temperatures from repeated pulsings. Preferably, the ceramic is alumina having an approximately 99% purity, and more preferably a 99.6% purity, available from the Accumet Engineering Corporation of Hudson, Mass. The substrate is dimensioned to provide an adequate surface area for the subsequently added heater layer and electrical contacts. For example, a substrate which is approximately 1.5–2 mm by 12–16 mm provides an adequate area for use in the smoking article of Ser. No. 08/105,346. Its thickness should be at least adequate to provide the required mechanical integrity to support itself and the heater, e.g., approximately 10 mil., but not significantly greater to avoid undesired thermal mass.

A thin film heater layer 30 is deposited on the ceramic substrate 20. Heater layer 30 is preferably a thin platinum film having a thickness of, e.g., approximately 0.4 μm (4000 Å). The heater layer 30 has an active surface area 35 to heat, e.g., tobacco flavor medium (36) in thermal proximity therewith. In one embodiment, an appropriate active surface area is approximately 18 sq. mm to actively heat a similarly sized area of tobacco flavor medium as described in Ser. No. 105,346 to generate aerosols equivalent to a puff of a more conventional cigarette.

The heater layer 30 is deposited onto substrate 20 by any suitable method such as DC magnetron sputter deposition, e.g., using an HRC 150 DC magnetron sputter deposition unit, in argon at $8.0\times10^{-3}$ Torr. Alternatively, other conventional techniques such as vacuum evaporation, chemical deposition, electroplating and chemical vapor deposition are employed to apply the heater layer 30 to the substrate layer 20.

The surface morphology of the substrate layer 20 is important to accomplish a successful deposition of the heater layer 30. Preferably, the substrate layer is lapped via a conventional serrated knife. Typical lapped alumina has an unpolished surface roughness between approximately 8 to 35 microinches. The substrate is then polished to a surface roughness having an arithmetic average greater than approximately one microinch, and more specifically between approximately one and approximately 100 microinches, and most preferably between approximately 12 and approximately 22 microinches. If the substrate is polished to further reduce surface roughness as in conventional ceramic substrate preparation, i.e., to a surface roughness of 1 microinch or less, an adequate deposition interface will not be formed.

The heater layer 30 and the substrate 20 should have closely matching coefficients of thermal expansion to reduce thermally induced interface stresses and delaminations as the heater layer is pulsed. The heater is heated up to approximately 1000° C. at its hottest area.

The heater layer 30 is coupled to an appropriate power source (not shown). The power source is any appropriate source, such as a DC source, e.g., as described in the parent and related applications. Contacts 40 are provided to electrically connect the heater layer 30 to wires leading to the power source. In one embodiment, shown in FIG. 1, the contact 40 comprises a gold coated tungsten wire. A preferred wire is a W-wire wool, commercially available from the Teknit Corporation of New Jersey, which is gold coated. Alternatively, the contact 40 comprises copper leads. The contacts 40 can contact the platinum heater layer 20 on or in the heater layer top surface or at any other location so long as an adequate electrical contact is achieved. Another preferred contact configuration achieving the electrical connection as well as mechanical support is discussed below in reference to FIGS. 2A–2C. The electrical current supplied via contacts 40 resistively heats the platinum heater layer 30. Contacts 40 are respectively electrically connected to two mounds of platinum heater layer 20 having active area 35 located therebetween, as discussed in greater detail below. The resistance of the thin platinum layer 30 is affected by the morphology of the underlying substrate 20.

Figure 2A:
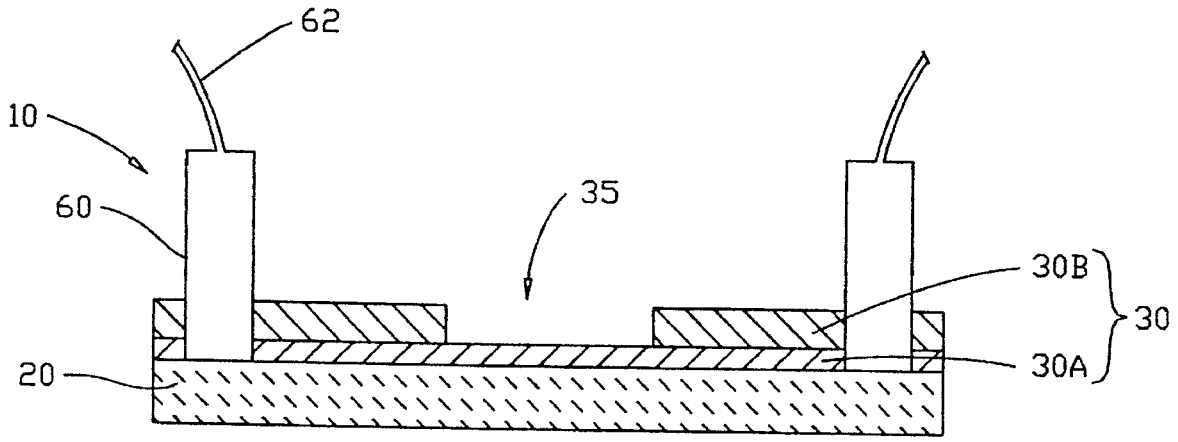
FIG. 2A is an exposed side view of a second embodiment of the heater according to the present invention.

Referring to FIG. 2A, another embodiment is shown employing electrically conductive posts 60 which serve both as electrical contacts and mechanical supports. The contact posts 60 are each preferably connected to the same side of substrate 20, and more specifically the side of the substrate 20 opposite the substrate side in thermal proximity to the article, e.g., tobacco flavor medium, to be heated, prior to deposition of the platinum heater layer 30 and are electrically connected to power source via wires 62. The contact posts 60 can be comprised of any desired material having good electrical conductance such as copper or other copper alloys such as phosphur bronze or Si bronze, and are preferably copper or any alloy having at least approximately 80% copper. The posts 60, or a bonding layer as discussed below, provide a low electrical resistance connection for use with the desired current of, e.g., approximately 5–10 amps. If copper or a copper alloy is not employed for post 60, then preferably an intermediate copper bonding layer is connected by any conventional technique to the end of post 60 to permit bonding between the post 60 and substrate 20 without affecting the electrical path. In addition to possessing adequate electrical conductance, the posts 60 have sufficient mechanical strength to support the substrate/heater layer laminate. The posts 60 further most maintain mechanical integrity during repeated thermal cyclings during the life of the heater. Further, the posts should have a coefficient of thermal expansion and geometric shape to provide adequate resilience to compensate for repeated temperature induced stresses. Since the posts 60 function both as the electrical contacts to platinum layer 30, and specifically mounded regions formed at each post 60 by platinum layer 30B, and as the mechanical support for substrate 20, the number of required components for the present heater is advantageously reduced. Also, parasitic electrical and/or thermal losses to a separate mechanical support element are eliminated. All electrical connections to the heater, e.g., contacts 50, posts 60, intermediate layer (if used), associated wires, etc. should have a resistivity less than that of the platinum heater 30 to prevent or reduce heating of these connections prior to heating of layer 30.

The connection of the post end to substrate 20 is preferably achieved by eutectic bonding wherein a surface of copper is oxidized, the resulting copper oxide surface is contacted with the ceramic, the copper-copper oxide ceramic is heated to melt the copper oxide but not the copper such that the melted copper oxide flows into grain boundaries of the ceramic, and then the copper oxide is reduced back to copper to form a strong bond. This connection can be achieved by a eutectic bonding process used by Brush Wellman Corporation of Newbury Port, Mass.

Next, the platinum heater layer 30 is applied to the ceramic electrical insulator substrate 20. As shown, the heater layer comprises of an initial layer 30A extending across the entire width of substrate 20 and the posts 60 and a contact layer 30B which electrically connects posts 60 to layer 30A. An active heating area 35 is thus defined on the portion of bottom layer 30A which is not covered by the additional contact layer 30B, i.e., which is located between the posts 60 and mounds formed by the additional layer 30B, as a result of, e.g., masking the heating area 35 prior to applying the subsequent mounded layer 30B.

Figure 3B:
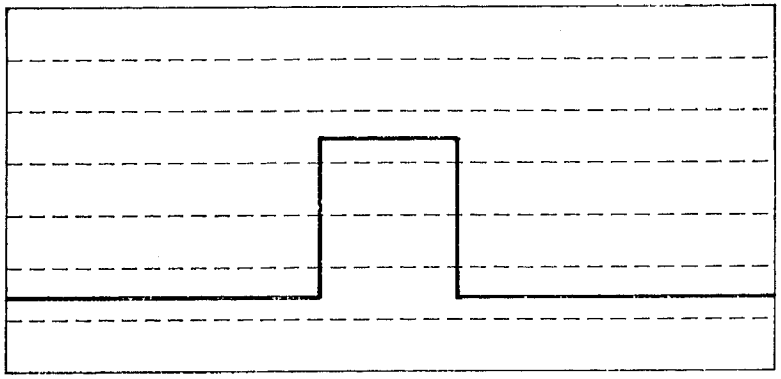
FIG. 3B is the corresponding resistance profile along the heater of FIG. 2A.
Figure 3A:
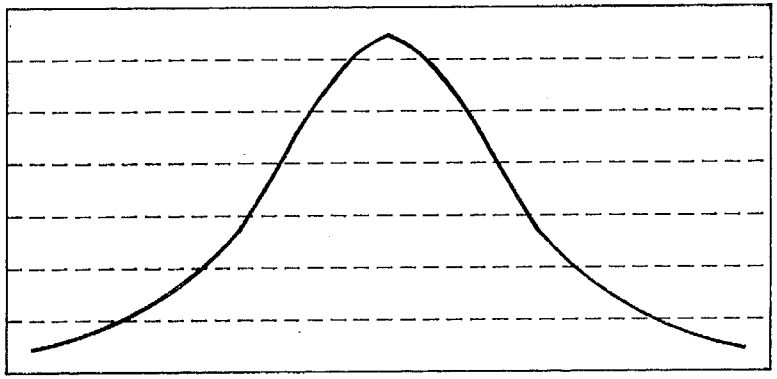
FIG. 3A is a graph showing the general temperature profile along the heater of FIG. 2A.

Mounds or thick regions are formed by contact layer 30B around the posts 60 and rise from the substrate surface plane to function as contacts. This grading of the platinum of heater layer 30 such that it is thicker at the posts 60 than at the active portion 35 between the posts 60 results in a step resistance profile as shown in FIG. 3B, which results in the general temperature profile shown in FIG. 3A. The profiled heater layer 30 is alternatively formed by applying an initial layer 30A comprising the active region 35 located between posts 60, masking region 35, and then applying the additional platinum layer 30B to form the mounds in a single step. Alternatively, the layer 30B is formed by multiple layerings. The foregoing description discusses the use of layering steps to form the layers and to profile the layer 30 into a relatively thin active portion 35 and thicker regions or mounds. Alternatively, the mounds can be formed by employing angular deposition techniques to ensure electrical contact between each connector post 60 and an edge of active portion 35. The layers 30A and 30B can be formed during the same step such that no discrete layering is present. Conventional masking techniques are employed in all cases to cover active portion 35 of the initial layer 30A during the described deposition(s). The active heater region is approximately 0.2 to 0.8 μm thick and the mounds are approximately 1.2 to 1.6 μm thick.

Such a resultant temperature profile concentrates or maximizes heat production in the centrally located active portion 35 such that heat is conducted through to an opposite side of the substrate 20, which in turn is in thermal proximity, i.e., in contact with or close enough to, the article such as the tobacco flavor medium to transfer heat to the tobacco flavor medium to generate flavors. In addition, the temperature profile reduces the amount of heat generated by the thicker gradings or mounds of the platinum layer 30B, which in turn reduces potentially damaging-heat diffusion via the posts 60 or wires 62. To further limit heat diffusion and to provide mechanical support, posts 60 in one alternative embodiment are connected to, e.g., terminate in, a thermal insulating support mount located at an end of the posts opposite the end contacting the platinum heating layers and connected to the substrate 20. This insulating support can in turn be connected, e.g., to a housing of an electrical smoking article. Preferably, thermal insulating support comprises PEEK® brand poly(ether)etherketone polymer available from Imperial Chemical Industries of Great Britain or Maylor.

These thicker gradings also prevent substrate 20 and the interconnections between the posts 60 or contacts 40 and the heater layers 30 from heating up excessively and possibly breaking desired electrical and/or mechanical contact. For example, the interconnection temperature is kept below approximately 400° C.

The overall resistance of these platinum heater layers is between, e.g., approximately 0.6 and 1.0 ohm at room temperature for the discussed application. Such a resistance limits the current required and decreases the power delivery, thereby increasing battery life and/or reducing battery capacity and size. In addition, this resistance results in a rapid initial application of power to enhance aerosol generation. The central active area 35 can thus be heated to approximately 900° to 1000° C. while the thickness gradings of the heater layers are heated to, e.g., approximately 200° C. The energy required for such a heater is between approximately 10 to 25 Joules, and more preferably between approximately 16 to 18 Joules. The preferred time to transfer this energy and obtain the desired heating from room temperature is approximately one second. This preferred time begins with an initial sensing of a puff and generation of a heater activation signal. The platinum layer 30 can be patterned onto substrate 20, especially in the region defining active area 35, in various geometric configurations to achieve a desired resistance, e.g. between approximately 1 ohm to approximately 100 ohms for the discussed and other applications.

Figure 2B:
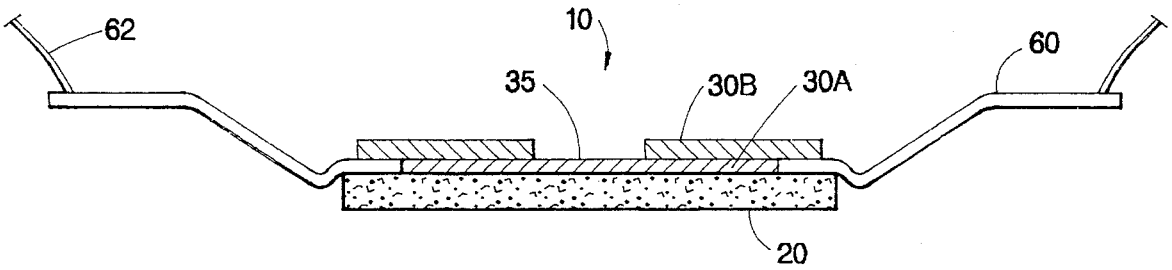
FIG. 2B is an exposed side view of an alternative third embodiment of the present invention having side supports.

In FIG. 2A, the posts 60 extend generally perpendicularly from the substrate 20. Alternatively, as shown in FIG. 2B, the copper posts or fingers 60 are bent into an S-shaped or Z-shape to minimize thermal stresses to these mechanical supports, which can be further attached at an opposite end from substrate 20 to support the substrate/heater laminate. As discussed above, the bent posts 60 provide electrical current via contacts 60 and form mechanical supports for the heater in thermal proximity with the tobacco flavor medium as well as permitting flexibility of the structure for thermally induced stresses. For example, the posts 60, whether straight or bent, would absorb mechanical stress from insertion, removal and adjustment of an article such as tobacco flavor medium since these elements define a bending arm for allow moment bending. The bent posts 60 shown in FIG. 2B absorb mechanical stress via the shown S- or Z-shape which permits the contact force to be transmitted through the shape. As shown, platinum layer 30B overlies an end of post 60 such that this post end is surrounded on an upper side by layer 30B; and on an upper side, two sides and an end face by platinum layers 30A and 30B.

Figure 2C:
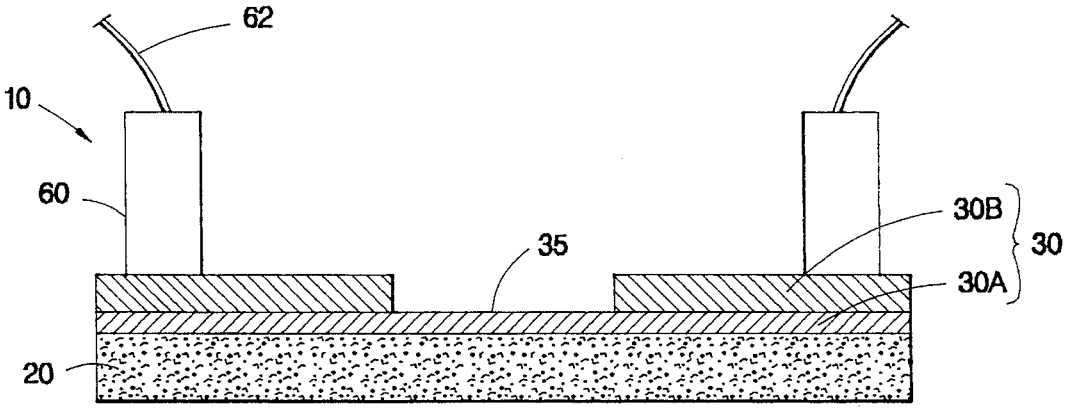
FIG. 2C is an exposed side view of a fourth embodiment of the present invention.

Referring to FIG. 2C, another embodiment of the present invention is shown wherein the posts 60 are attached after platinum layers 30A and 30B are deposited onto substrate 20. Any appropriate technique can be employed so long as good ohmic contact and mechanical connections are attained. For example, the platinum layer is applied as discussed. The copper posts are contacted with the heater layer, and the assembly is heated, e.g. in a tubular furnace to a readout of approximately 1070° C. in an inert atmosphere of nitrogen with a 3 SL/M flow rate. An appropriate heating rate is employed, e.g., 20° C./min. and a dwell time of 6–12 minutes. A furnace cooling rate was used while the nitrogen is flowing until the assembly is approximately room temperature. The foregoing method of fabrication is by way of non-limiting example only. As in the preceding embodiments, the posts 60 should be copper having a relatively high oxygen content, e.g., approximately 10 to 12%. This embodiment offers the advantages of forming a strong mechanical connection between the posts 60 and the ceramic, e.g. 99.6% pure alumina, substrate 20 via the interposed heater layer 30 and of forming a good ohmic connection between the posts 60 and the heater layer 30 for resistance heating. This ohmic connection is achieved without the need for angular deposition or mounding of heater layer 30, although such formations can be employed. It is noted that the layer dimensions in FIG. 2C are exaggerated and that post 60, platinum layers 30A and 30B, and substrate 20 are tightly bonded to one another.

In the configurations depicted in FIGS. 1 and 2A–2C, the surface of the electrically insulating substrate 20 facing, an article such as the tobacco flavor medium is opposite the active portion 35 of heater 10. Heat generated by heater 10 is transferred through the substrate 20 to heat the oppositely located tobacco flavor medium such that flavor containing aerosols are generated. As noted above, the substrate 20 is only required to be thick enough to support the heater and itself, e.g., approximately 10 mil of the noted ceramic, and accordingly heat is transferred though the substrate 20 without significant loss. In addition, the relatively short, e.g., approximately one second, pulse of energy to the heater results in a similarly quick pulse of heat through the substrate 20, further minimizing heat loss. The location of the mechanically supporting and electrically conducting posts on the side of substrate 20 with the heater layer 30 provides an unobstructed opposite side of the substrate 20 for heating. For example, such a configuration is desirable when a web of tobacco flavor medium as in Ser. No. 08/105,346 is successively advanced in thermal registry with this opposite side.

As noted above, heater 30 is preferably comprised of platinum since platinum does not experience high temperature-induced oxidation. High grade purities of platinum, e.g., approximately 99.99% pure, can be employed. In addition to incidental impurities, the platinum can contain up to 10% by weight of rhodium so long as the desired oxidation resistance is maintained.

Figure 4:
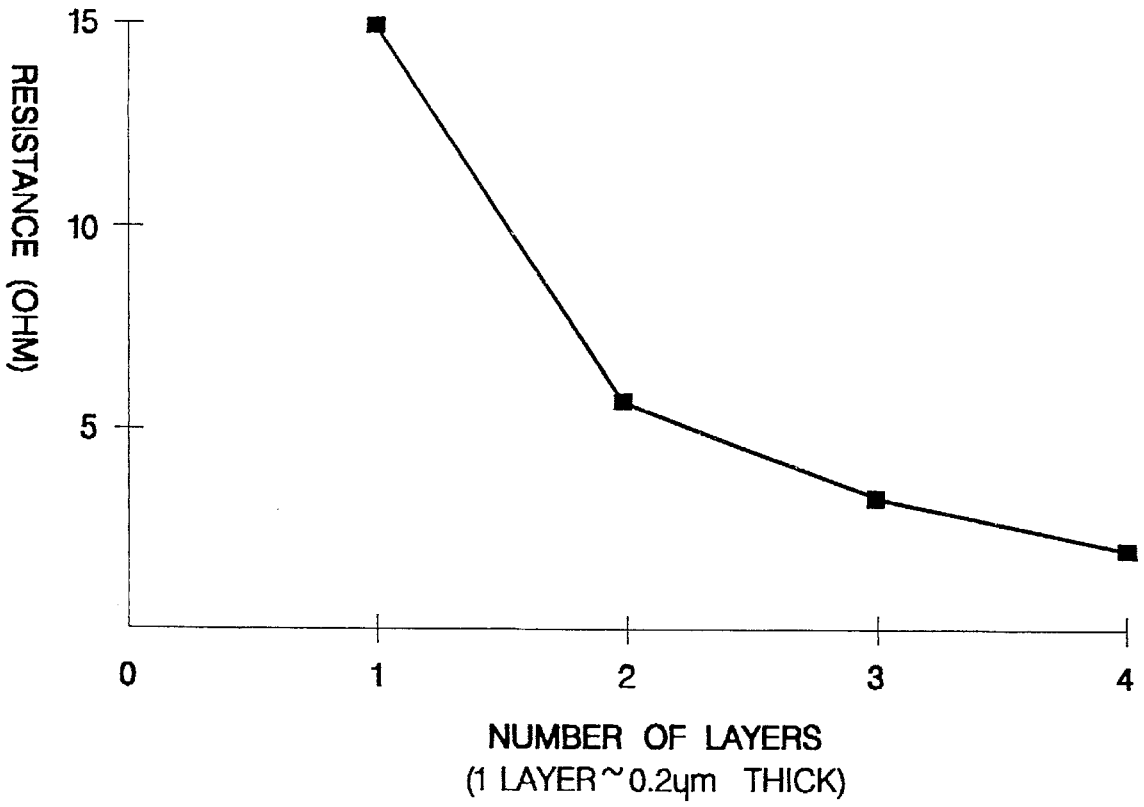
FIG. 4 is a graph showing the resistance changes as a function of the number of approximately 2 μm thick increments of platinum film.

Although platinum possesses desirable resistance to oxidation, the electrical resistivity of bulk platinum is relatively low at 10.6 μ-ohm-cm. However, the resistance of heater 10 is a function of the film thickness rather than the material composition. The resistance of the heater layer 30 is precisely controlled by adjusting this layer of thickness and/or length of the profiled zone. FIG. 4 graphs the electrical resistance as a function of approximately 0.2 thick platinum layers.

The surface morphology is changed during the first heating following the diffusion bonding and is relatively stabilized thereafter. This morphology change results in a decrease in the resistivity of approximately 50% for the active area 35 and mounds 32. The initial heating is thought to increase the heater film density by melting the film to form relatively lower free energy structures which, upon solidification, form denser films to decrease their surface free energy. The initial heating of, e.g., approximately 900°

C., can be done during fabrication, e.g., in an oven, or by the first use of the heater in the smoking article by a consumer or prior to sale.

In addition to desired oxidation resistance and morphology induced electrical resistivity, the thin platinum or platinum based heater layer 30 has an electrical resistance which increases as the temperature of heater layer 30 increases via resistance heating from the power source, which is preferably constant voltage. As a result, more power is drawn during the beginning portion of the heating period than at the end portion, resulting in a desirable self-limiting power consumption feature of the heater layer 30.

Figure 5A:
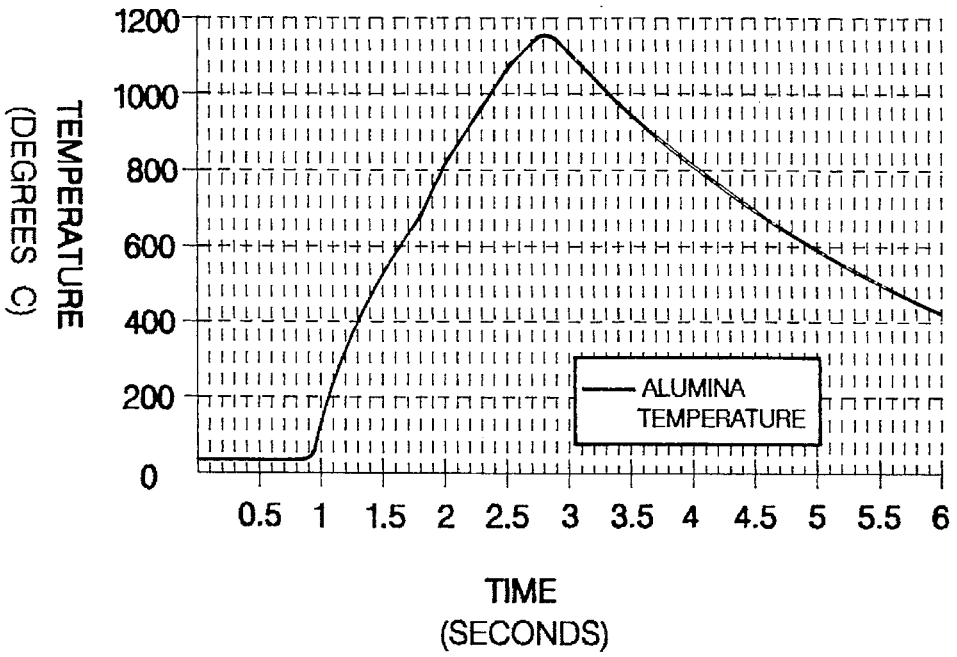
FIG. 5A is a graph of the temperature rise of a side of a ceramic substrate opposite a deposited thin film of primarily platinum of a heater according to FIG. 2A.
Figure 5B:
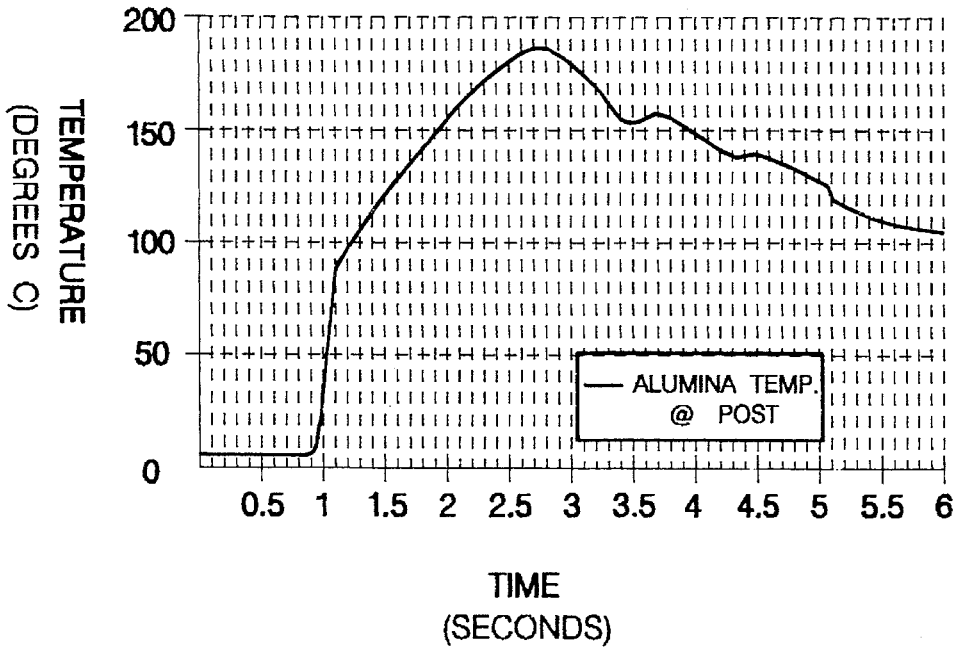
FIG. 5B is a graph of the temperature rise of bonded copper posts of a heater according to FIG. 2A.

The power source provides a pulse of energy to the heater in response to an indication that a puff is being taken on the smoking article, as described more fully in the parent and related applications. For example, a one second pulse of approximately 18 Joules was applied to the embodiment of FIG. 2A, resulting in the side of ceramic substrate 20 facing the tobacco flavor medium, i.e., the side opposite active area 35 of heater 30, being heated to a maximum of approximately 1100° C. The mounds defined by layer 30B, on the other hand, were only heated to approximately 150° C. to 220° C. Referring to FIG. 5A, repeatable rise times of 800 msec were observed from room temperature to approximately 700° C. with 16.2 Joules of input energy during the rise time (note that all times take into account an approximately one second "flat" time in the graphs of FIGS. 5A and 5B). At the end of one second, the temperature of the alumina substrate 30 was approximately 900° C. A maximum of approximately 1100° C. was reached at approximately 1.9 seconds. Such temperatures will generate desired aerosols from tobacco flavor medium. As shown in FIG. 5B, the copper post 60 was heated to approximately 150° C. during this 800 msec rise time and reached a peak temperature of approximately 180° C. after approximately 1.7 seconds. The posts thus stay cool enough to provide mechanical strength to support the heater, e.g., if the heater is supported within a housing of a smoking article. Such a heater has been pulsed at 20 Joules/pulse for over 117,000 pulses, which is the equivalent of approximately 2 pack-years, i.e., a pack a day for a year, for a single heater employed in the apparatus of parent application Ser. No. 08/105,346. No measurable degradation was observed. These temperatures conform to the general temperature profile of FIG. 3B. The platinum film heater layers do not experience oxidation at the described operating temperature or above.

As noted above, the electrical connections to heater layer 30 should be less resistive than platinum to prevent heating of the connections faster than layer 30. Also heat conduction through the contacts should be minimized. As noted, the temperature profile due to shaping layer 30 significantly reduces heat available to the connections. Any combination of contacts can be employed.

A generally planar, flat substrate 20 is shown in FIGS. 1 and 2A. Since substrate 20 is preferably a ceramic, the substrate can have a variety of geometric forms to increase strength and lessen thermal mass since the heat pulse for resistively heated platinum layer 30 preferably passes through substrate 20 to heat the tobacco flavor medium. For example, substrate 20 is shaped as a U-channel or curved, wherein the curved substrate 20 has a convex surface facing to the tobacco flavor medium and a concave surface bearing the applied platinum layer 30, or visa versa.

Alternatively to the embodiments of FIGS. 1 and 2A–2C, the contact can comprise a pressure contact of a flexible wire-woven metallic contact. The metal is coated, e.g., gold coated, to prevent oxidation degradation and corrosion. The flexible contact has a highly porous structure, e.g., up to approximately 90% porosity, to reduce heat conduction while providing ohmic contact. An appropriate contact mount should be employed to reduce the effects of wire creep, resulting in high contact resistance, and possibly loss of gold encapsulation, as the unit is repeatedly cycled. This flexible contact can take the form of a washer bolted to or otherwise held in contact with the heater layer 30.

In all of the foregoing embodiments, the article, e.g., tobacco flavor medium, is preferably in contact with the side of the ceramic substrate opposite the applied thin film platinum layer. More specifically, all of the electrical and mechanical connections for the heater are located on this opposite side, providing a smooth ceramic interface via the substrate which is in thermal contact with the tobacco flavor medium. In addition, after heating the tobacco flavor medium, it is preferred to pulse the heater again with no new tobacco flavor medium in registration therewith to burn off any burned residue of heated tobacco flavor medium which may be present on the heater surfaces.

Many modifications, substitutions and improvements may be apparent to the skilled artisan without departing from the spirit and scope of the present invention as described and defined in the foregoing description and following claims.

We claim:

1. A heater adapted for use in an electrical smoking article to heat tobacco flavor medium, the heater comprising:

a ceramic substrate;

a heater layer deposited on said ceramic substrate, said heater layer comprising primarily platinum; and copper contacts deposited on the platinum heater layer which are eutectically bonded to said platinum heater layer and said ceramic layer, and form an ohmic contact between the copper and platinum.

2. The heater according to claim 1, wherein said substrate comprises a ceramic selected from the group consisting of alumina, zirconia, yttria stabilized zirconia, and titania.

3. The heater according to claim 1, wherein a thickness of said platinum heater layer is greater than a surface roughness of said ceramic layer.

4. The heater according to claim 1, wherein said ceramic layer has a surface roughness greater than approximately one microinch.

5. The heater according to claim 1, wherein said heater layer consists essentially of platinum.

6. The heater according to claim 1, wherein said layer consists essentially of platinum and no more than approximately 10% by weight of rhodium.

7. The heater according to claim 1, wherein said heater layer and said ceramic layer have closely matching coefficients of thermal expansion.

8. The heater according to claim 1, wherein said platinum heater layer has a thickness such that the electrical resistance of said heater layer is affected by a surface morphology of said ceramic substrate.

9. The heater according to claim 1, wherein said electrical connection comprises wires connected to said heater layer.

10. The heater according to claim 1, wherein said platinum heater layer has an overall resistance of between approximately 1 and 100 ohm at room temperature.

11. The heater according to claim 1, wherein said platinum heater layer has an overall resistance of approximately 0.6–1 ohm at room temperature.

12. The heater according to claim 1, wherein said ceramic substrate has a surface roughness of approximately 1–100 microinches.

13. The heater according to claim 1, wherein said ceramic substrate has a surface roughness of approximately 12–22 microinches.

14. The heater according to claim 1, wherein said substrate is curved.

15. The heater according to claim 1, wherein said platinum heater layer has a step resistance profile such that said heater layer has a lower resistance at each of said electrical connections and a higher resistance therebetween.

16. The heater according to claim 1, wherein said platinum heater layer is initially pulsed with energy, wherein an electrical resistance of said platinum heater layer is lowered to a subsequent value.

17. The heater according to claim 1, wherein said platinum heater layer comprises two mounds with a region extending therebetween.

18. The heater according to claim 17, wherein said mounds are between approximately 1.2 to 1.6 μm thick and said region is between approximately 0.2 to 0.8 μm thick.

19. The heater according to claim 17, wherein said platinum heater layer region extending between said two mounds has a thickness which is less than said mounds.

20. The heater according to claim 19, wherein said mounds are between approximately 1.2 to 1.6 μm thick and said region is between approximately 0.2 to 0.8 μm thick.

21. The heater according to claim 1, wherein said electrical connectors comprise a first and second electrically conducting strip, each strip electrically connected at a first end to said platinum heater layer.

22. The heater according to claim 21, wherein at least one of said first and second conducting strips is shaped at a first end portion to reduce stress applied to said substrate and the at least one conducting strip.

23. The heater according to claim 1, wherein said electrical connections respectively terminate at a first end within said platinum heater layer, a second end of each electrical connection adapted to supply power to said platinum heater layer.

24. The heater according to claim 23, wherein said platinum heater layer comprises two mounds, the first end of a respective electrical connection terminating in a respective mound.

25. A heating apparatus adapted for use in an electrical smoking article to heat tobacco flavor medium, the heating apparatus comprising:

a ceramic heater, said heater comprising a ceramic substrate;

a heater layer deposited on said ceramic substrate, said heater layer comprising primarily platinum; and tobacco flavor medium;

wherein the heater is positioned such that a side of said substrate opposite said heater layer is facing the tobacco flavor medium.

26. A method of fabricating a heater to heat an article, comprising the steps of:

providing a ceramic material depositing a heater layer on the ceramic substrate, the heater layer comprising primarily platinum;

depositing copper contacts at separate locations upon the heater layer; and eutectically bonding the copper contacts to the heater layer and ceramic material such that an ohmic contact forms between the copper contact and heater layer.

27. The method according to claim 26, wherein said depositing step comprises forming a first mound and a second mound of the heater layer on the ceramic substrate such that a relatively thinner region of the heater layer is formed therebetween, the mounds electrically connected to the electrical connection.

28. The method according to claim 26, further comprises polishing the lapped ceramic substrate to a surface roughness between approximately 12 microinches and approximately 22 microinches.

29. The method according to claim 26, wherein the deposited heater layer has a thickness greater than the surface roughness of the provided ceramic substrate.

* * * * *